US007775247B2

(12) United States Patent
Sinopoli et al.

(10) Patent No.: US 7,775,247 B2
(45) Date of Patent: Aug. 17, 2010

(54) STEEL CORD FOR REINFORCEMENT OF OFF-THE-ROAD TIRES

(75) Inventors: Italo Marziale Sinopoli, Canton, OH (US); Barry Allen Matrana, Akron, OH (US); Charles Elmer Hamiel, Stow, OH (US); James Christopher Kish, Akron, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 810 days.

(21) Appl. No.: 11/315,507

(22) Filed: Dec. 22, 2005

(65) Prior Publication Data

US 2007/0144648 A1 Jun. 28, 2007

(51) Int. Cl.

| | |
|---|---|
| ***B60C 9/00*** | (2006.01) |
| ***B60C 9/18*** | (2006.01) |
| ***D07B 1/06*** | (2006.01) |
| ***D02G 3/48*** | (2006.01) |

(52) U.S. Cl. ..... 152/451; 152/526; 152/527; 152/556; 428/357; 428/364; 428/544

(58) Field of Classification Search ..... None
See application file for complete search history.

(56) References Cited

U.S. PATENT DOCUMENTS

| | | | | |
|---|---|---|---|---|
| 3,632,455 A | | 1/1972 | Nakamura | 148/12.4 |
| 4,106,957 A | | 8/1978 | Tournoy | 148/12 B |
| 4,371,025 A | | 2/1983 | Canevari et al. | 152/352 R |
| 4,947,638 A | * | 8/1990 | Nagamine et al. | 57/212 |
| 5,010,937 A | | 4/1991 | Janus | 152/531 |
| 5,221,378 A | | 6/1993 | Nishiura et al. | 148/596 |
| 5,234,044 A | | 8/1993 | Bourgois | 152/527 |
| 5,386,860 A | | 2/1995 | Massie, II et al. | 152/198 |
| 5,709,760 A | | 1/1998 | Prakash et al. | 152/556 |
| 5,839,264 A | | 11/1998 | Uchio | 57/237 |
| 5,843,583 A | | 12/1998 | D'Haene et al. | 428/592 |
| 6,016,858 A | | 1/2000 | Roesgen et al. | 152/209 |
| 2004/0016497 A1 | | 1/2004 | Morgan et al. | |

FOREIGN PATENT DOCUMENTS

| | | | |
|---|---|---|---|
| EP | 0 795 425 | | 9/1997 |
| EP | 0834613 | | 4/1998 |
| JP | 59-67107 | * | 4/1984 |
| JP | 2107743 | | 4/1990 |
| JP | 8218282 | | 8/1996 |
| JP | 2000144587 | * | 5/2000 |
| JP | 2003-227081 | * | 8/2003 |

OTHER PUBLICATIONS

Machine translation of JP 2003-227081 (original document published in Aug. 2003).*
European Search Report, completed May 27, 2008.

* cited by examiner

*Primary Examiner*—Justin Fischer
(74) *Attorney, Agent, or Firm*—Robert N. Lipesik

(57) ABSTRACT

A steel cord, formed of a plurality of steel filaments, has a construction of N×(7×2) wherein N=1 to 7 and within the circumference of the cross-sectional area, not more than 60% of the cord area is comprised of the steel filaments. The steel cord has an elongation at break of at least 3%.

10 Claims, 3 Drawing Sheets

STEEL CORD FOR REINFORCEMENT OF OFF-THE-ROAD TIRES

FIELD OF THE INVENTION

The present invention relates to a steel cord for the reinforcement of rubber articles. More specifically, the invention is directed to a large, open steel cord for reinforcing the belt region of an off-the-road tire.

BACKGROUND OF THE INVENTION

Large off-the-road vehicles, such as dump trucks and construction vehicles, are subjected to extreme road conditions including rough roads, exposed sharp edged rocks, wood pieces, and shrubs. Such tires are typically provided with multiple layers of steel belts to provide for strength, penetration and cut resistance wherein the top belts of a given construction in the tire are considered the "protective" belts for the underlying working belts of the tire. Typical cord constructions in the steel belt layers include 7×7, 4×2, and 3×7.

In recent years, with the availability of higher strength steels for making tire cords, cords are being developed to manufacture smaller or simpler, high strength constructions for weight and cost savings. The greater strength provided by these cords is desirable; however, the smaller cords may lead to reduced cut resistance of the tire.

SUMMARY OF THE INVENTION

The present invention is directed to a steel cord for reinforcing off-the-road tires and a tire containing such a steel cord. More specifically, the present invention is directed to a steel cord for top belts of an off-the-road tire and a tire containing such a steel cord in the top belts wherein the cord construction is provided for good cut resistance, high resistance to impact, and improved corrosion resistance.

Disclosed herein is a steel cord for reinforcement wherein the steel cord is formed of a plurality of steel filaments and the cord has an overall circular cross-sectional area. The cord has a construction of N×(7×2) wherein N=1 to 7 and within the circumference of the cross-sectional area, not more than 60% of the cord area is comprised of the steel filaments. Preferably, not more than 50% of the cord area is comprised of the steel filaments. The steel filament area will decrease even further as N increases for large cord constructions. The "openness" of the cord construction permits greater rubber penetration, improving the corrosion resistance and maintaining elongation properties of the cord when encased in rubber.

In one aspect of the invention, the steel cord has an elongation at break of at least 3%. Preferably, the steel cord has an elongation at break in the range of 4 to 6%.

In another aspect of the invention, the steel cord filaments forming the steel cord have a diameter in the range of 0.25 to 0.55 mm.

In another aspect of the invention, the steel filaments forming the cord have a tensile strength at least defined by the equation of TS (MPa)=3650 MPa−(1500 MPa/mm)×D where D is the filament diameter in mm. The steel filaments may also have a strength in the "mega" tensile range, that is, the steel cord filaments have a tensile strength of at least 4800 MPa−(2000 MPa/mm)×D, where D is the filament diameter in mm.

Also disclosed is a pneumatic off-the-road radial tire. The tire has a tread, a radial carcass, and a belt structure, wherein the belt structure has at least one working belt layer and includes at least one outermost protective belt layer. At least one of the belt layers is formed of a steel cord wherein the steel cord has a construction of N×(7×2) wherein N=1 to 7. Within the circumference of the cross-sectional area of the cord, not more than 60% of the cord area is comprised of the steel filaments. Preferably, not more than 50% of the cord area is comprised of the steel filaments.

In another aspect of the invention, the steel cords in the belt layer have an elongation at break of at least 3.0%.

In another aspect of the invention, the belt structure of the tire has at least four belt layers, and at least the radially outermost belt layer is comprised of the N×(7×2) steel cords. Alternatively, the two radially outermost belt layers may be formed of the N×(7×2) steel cords.

BRIEF DESCRIPTION OF THE DRAWINGS

The invention will be described by way of example and with reference to the accompanying drawings in which.

DETAILED DESCRIPTION OF THE INVENTION

The following language is of the best presently contemplated mode or modes of carrying out the invention. This description is made for the purpose of illustrating the general principles of the invention and should not be taken in a limiting sense. The scope of the invention is best determined by reference to the appended claims.

Figure 1A:
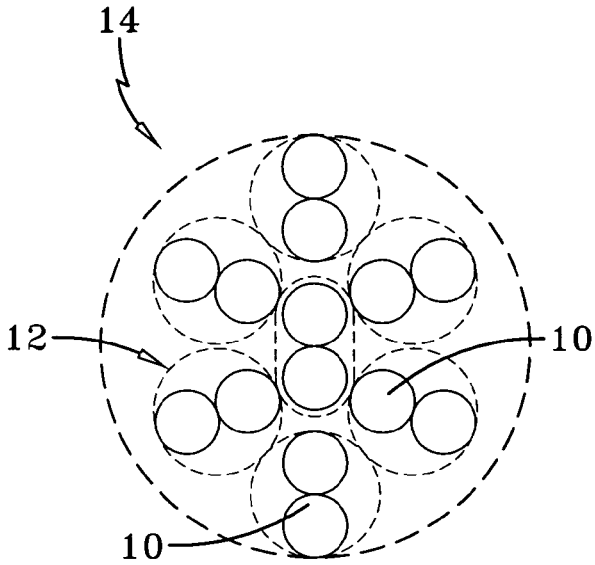
FIGS. 1A-1C are sectional views of steel cords according to the invention.
Figure 1B:
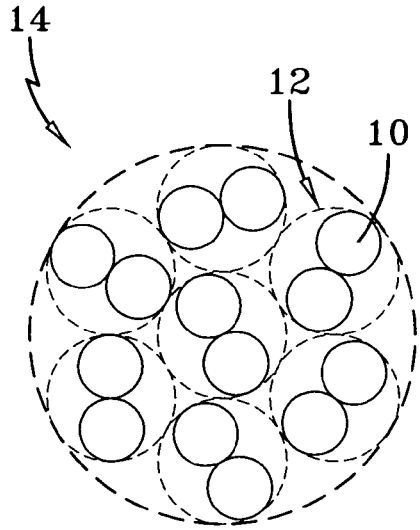
Figure 1C:
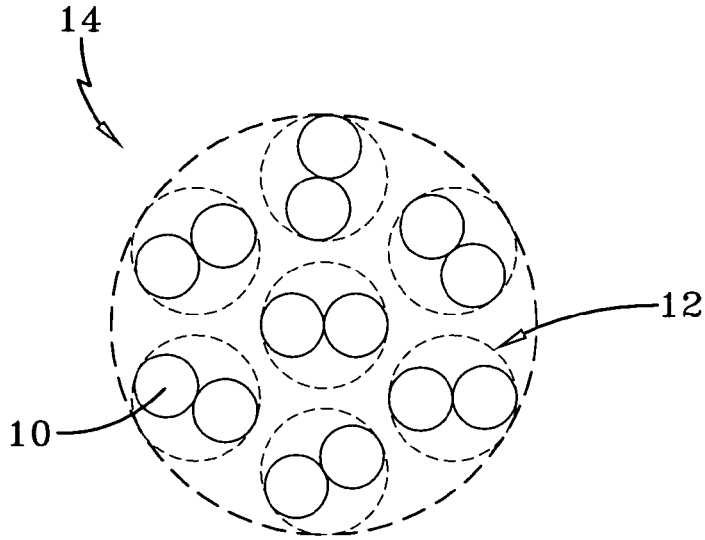

FIG. 1A illustrates a 7×2 cord structure made by twisting together two steel filaments 10 into a strand 12, and then twisting together seven of the strands 12 to form a cord 14. FIG. 1B illustrates another 7×2 cord wherein the cord 14 has a less organized structure thereto, providing for more spacing between the strands 12, thereby increasing the elongation property of the cord. The cord of FIG. 1C maintains even greater spacing between the strands 12.

Figure 5:
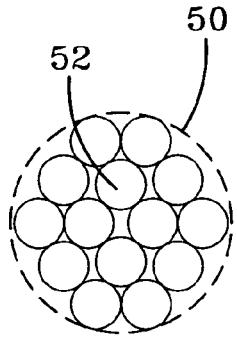
FIG. 5 is a sectional view of a conventional steel cord.
Figure 4:
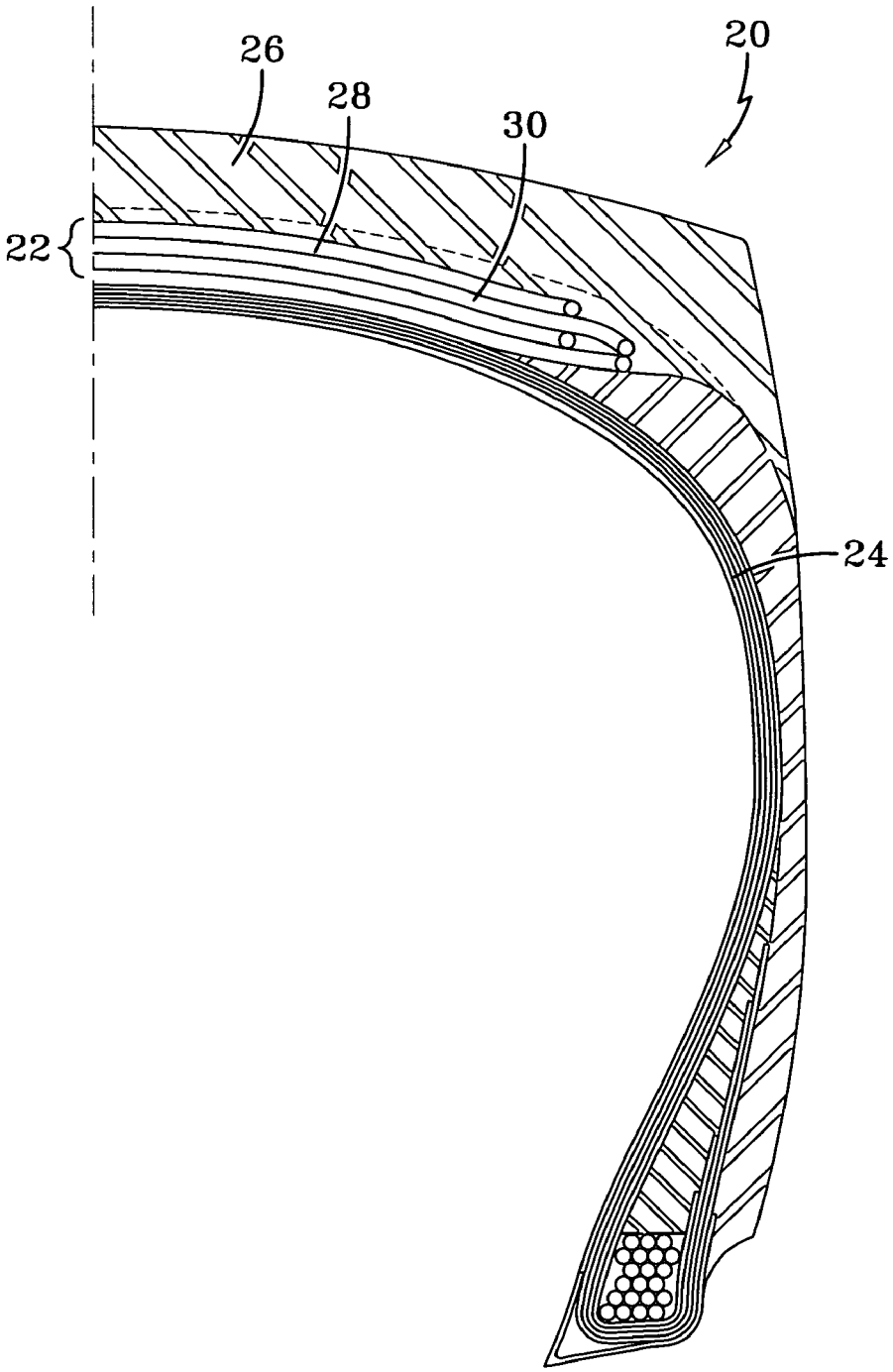
FIG. 4 is a section view of an off-the-road tire.

The cord 14 is twisted so as to have an "open" construction design to facilitate rubber penetration into the cord, the spacing between the strands 12 may be maintained by any spacing method such as crimping or helically winding of the steel filaments 10 and/or strands 12. The open construction design is best illustrated by a comparison to the cord 50 of FIG. 5. The cord 50, which is not part of the present invention, also has a total of fourteen steel filaments 52 twisted together to form the cord 50. However, the twisting results in a bundled-like cord construction. This cord 50 has a very tight construction, decreasing the ability of any coating rubber to penetrate the cord 50 to reach the innermost filaments 52.

In the cords of the present invention, the strands 12 maintain an open configuration so that in the total cross-sectional area of the cord 14, as calculated by a cord diameter, the steel filaments 10 do not comprise more than 60% of the total cross-sectional area of the cord. Preferably, not more than 50% of the cross-sectional area of the cord is comprised of the steel filaments 10. The open construction enables the coating rubber to penetrate to the innermost cord filaments. By increasing the rubber penetration, if there are any cuts in the belt layer formed with the steel cords, the chance of moisture exposure of the actual steel filaments or moisture penetration along the length of the cords is reduced, thereby improving corrosion resistance of the belt layer.

In forming the cords, the lay length of the individual strands 12 and the cord 14 is made small in order to yield a cord 14 having high elongation properties. The individual strands 12 have a lay length in the range of 2 to 10, that is 2 to 10 full turns of the strands 12 per mm, the actual value being dependent on the filament diameter. Due to the low lay length, the cord 14 has an elongation at break of at least 3%, preferably in the range of 3 to 7%, most preferably 4-6%. Having such steel cords in the top belt layers of a tire belt structure improves the durability of the top belts and increases the impact rupture energy to improve the cut resistance of the tire. If the elongation at break is higher than 7%, the strength of the cord is usually reduced, requiring a greater number of cords to meet tire design requirements.

The steel filaments forming the cords have a diameter in the range of 0.25 to 0.55 mm to improve the cut resistance of the tire. The steel filaments 10 forming the cords preferably have a tensile strength at least in the range of high tensile steel strength, that is, the tensile strength is at least defined by the equation of TS (MPa)=3650 MPa−(1500 MPa/mm)×D where D is the filament diameter in mm. The tensile strength may also be in the mega tensile range wherein the filaments have a tensile strength at least defined by the equation of TS (MPa) =4800 MPa−(2000 MPa/mm)×D where D is the filament diameter in mm.

Multiple examples of cords were constructed to determine the elongation values that can be obtained by the use of a 7×2 cord. All of the cords were constructed using steel filaments having a diameter of 0.40 mm, a tensile breaking load of about 400 N, and an initial elongation at break of 2.62%. The cord examples are set forth in Table 1 below.

TABLE 1

| | Cord 1 | Cord 2 | Cord 3 | Cord 4 | Cord 5 |
|---|---|---|---|---|---|
| Center Strand, lay length, mm | 4.5 | 4.5 | 4.5 | 4.5 | 6.0 |
| Outer Strand, lay length, mm | 4.5 | 4.5 | 6.0 | 6.0 | 6.0 |
| Cord lay length, mm | 8.2 | 10.5 | 8.2 | 10.5 | 10.5 |
| Overall cord diameter, mm | 2.37 | 2.35 | 2.38 | 2.30 | 2.35 |
| Cord breaking load, N | 3228 | 3478 | 3595 | 4252 | 3806 |
| Elongation at break, % | 4.23 | 3.36 | 4.31 | 4.19 | 3.34 |
| % steel in cross sectional area | 39.9 | 40.5 | 39.5 | 42.3 | 40.5 |

When the data for cords 1 and 2 are compared to each other and the data for cords 3 and 4 are compared to each other, each set of cords having the same center strand and outer strand lay lengths, but differing cord lay lengths, it can be seen that the lower cord lay length yields a higher elongation at break for the cord, but reduced breaking load. When cords 1 and 3 are compared to each other, and cords 2 and 4 are compared to each other, each set herein having the same center strand construction and cord lay lengths but different outer strand lay lengths, it can be seen that with increasing the outer strand lay length only, the cords have a higher breaking load and an increased elongation at break. However, increasing the lay length of all the strands, as seen with cord 5, while yielding a cord with desired elongation at break, does not inherently yield a cord with both increased elongation and increased breaking load, as seen in a comparison between cords 4 and 5.

Figure 2:
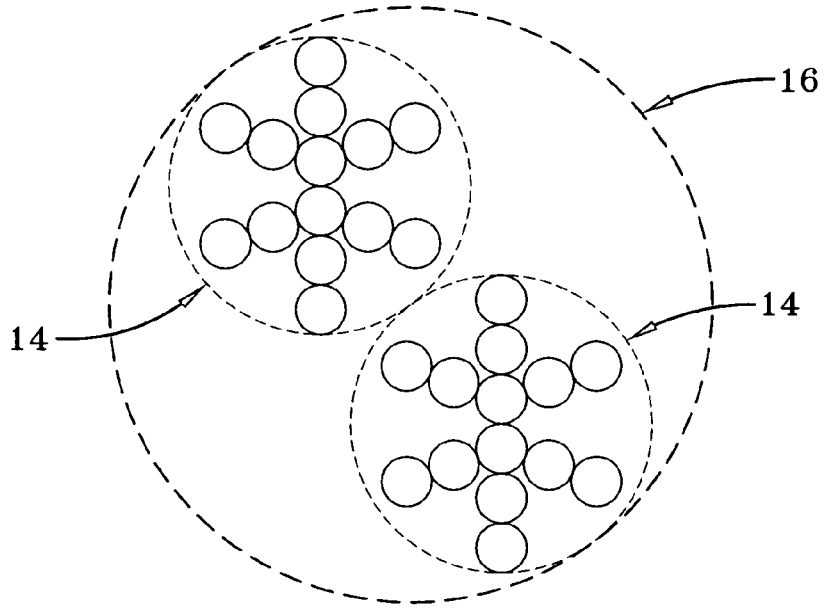
FIGS. 2 and 3 are sectional views of other steel cords according to the invention.
Figure 3:
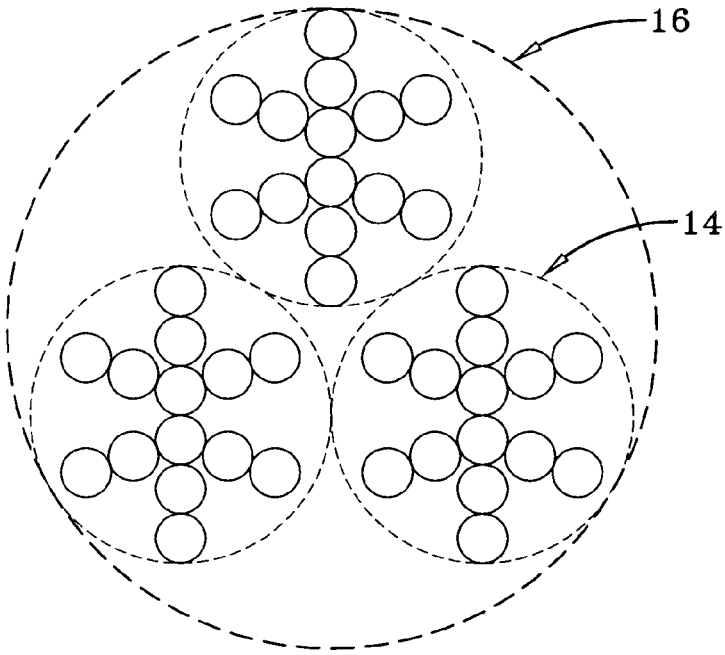

Multiple 7×2 cords 14 may be combined to form a larger reinforcing steel cord 16, as seen in FIG. 2, having a cord construction of 2×(7×2), and FIG. 3, having a cord construction of 3×(7×2). In accordance with the invention, the steel reinforcing cords have constructions of the form N×(7×2), wherein N is in the range of 1 to 7. The cords 16 have overall circular circumferences defined along the illustrated dashed circles. The diameter of the cords 16 is determined by the outermost surface of the core filaments 10. The larger cords 16 of FIGS. 2 and 3 are illustrated using the cord 14 of FIG. 1A; it will be appreciated that the larger cords 16 may be formed using the cords 14 of FIGS. 1B and 1C or any other 7×2 cord that meets the desired steel filament cross sectional area and achieves the desired elongation at break of at least 3%.

Below are example constructions of reinforcement layers using a larger cord construction according to the invention, with the cord ends per inch in the ply adjusted to maintain the rivet at a constant value of approximately 0.050 inches.

TABLE 2

| | 3 × (7 × 2) | 3 × (7 × 2) | 3 × (7 × 2) |
|---|---|---|---|
| Filament diameter, mm | 0.25 | 0.30 | 0.35 |
| Breaking Load, N | 5468 | 7671 | 10167 |
| Cord diameter, mm | ≈3.0 | ≈3.6 | ≈4.2 |
| Ends per inch | ≈5.9 | ≈5.2 | ≈4.6 |
| Inch-strength N/in | 32261 | 39889 | 46768 |

FIG. 3 illustrates a cross section of half of an off-the-road tire 20 having a belt structure 22, a radial carcass structure 24 comprising one or more reinforcing plies extending between a pair of bead portions, and a tread 26. Radially outward of the carcass structure is a belt structure of multiple reinforcing layers; four layers being illustrated in the exemplary tire. The belt structure 22 has at least one working belt and at least one top protective belt 28 of steel cords having a construction of N×(7×2). Depending on the desired performance characteristics of the tire, the two radially outermost belt layers 28, 30 may be formed with steel cords having a construction of N×(7×2).

While the present cord structure is disclosed as being used in off-the-road tires, the cord may be employed in other types of structures including other types of tires, such as aircraft tires and radial medium truck tires, hoses, conveyor belts, power transmission belts, and reinforced tracks, also known as rubber crawler belts.

What is claimed is:

1. A pneumatic off-the-road radial tire comprising a tread, a radial carcass, and a belt structure, wherein the belt structure has at least one belt layer including an outermost belt layer, wherein the at least one belt layer is comprised of a steel cord, wherein the steel cord is formed of a plurality of steel filaments having diameters of 0.4 mm, the cord having an overall circular cross-sectional area and a construction of N×(7×2) wherein N=2 to 7; and within the circumference of the cross-sectional area, not more than 60% of the cord area is comprised of the steel filaments, each 7×2 cord having a cord lay length of 10.5 mm and outer strands with lay lengths of 6.0 mm such that each 7×2 cord has an axial elongation at break of at least 4%.

2. The tire of claim 1 wherein the steel cord has an overall circular cross-sectional area, and within the circumference of the cross-sectional area, not more than 50% of the cord area is comprised of the steel filaments.

3. The tire of claim 1 wherein the steel cord filaments have a tensile strength at least defined by the equation of TS (MPa) =3650 MPa−(1500 MPa/mm)×D, where D is the filament diameter in mm.

4. The tire of claim 1 wherein the steel cord filaments have a tensile strength at least defined by the equation of TS (MPa) =4800 MPa−(2000 MPa/mm)×D, where D is the filament diameter in mm.

5. The tire of claim 1 wherein the belt structure has at least four belt layers, and at least the radially outermost belt layer is comprised of the N×(7×2) steel cord.

6. The tire of claim 1 wherein the belt structure has at least four belt layers, and at least the two radially outermost belt layers are comprised of the N×(7×2) steel cord.

7. A steel cord for reinforcement wherein the steel cord is formed of a plurality of steel filaments having diameters of 0.4 mm, the cord having an overall circular cross-sectional area and a construction of N×(7×2) wherein N=2 to 7; and within the circumference of the cross-sectional area, not more than 60% of the cord area is comprised of the steel filaments, each 7×2 cord having a cord lay length of 8.2 mm and a center strand with a lay length of 4.5 mm such that each 7×2 cord has an axial elongation at break of at least 4%.

8. The steel cord of claim 7 wherein the steel cord has an overall circular cross-sectional area, and within the circumference of the cross-sectional area, not more than 50% of the cord area is comprised of the steel filaments.

9. The steel cord of claim 7 wherein the steel cord filaments have a tensile strength at least defined by the equation of TS (MPa)=3650 MPa−(1500 MPa/mm)×D where D is the filament diameter in mm.

10. The steel cord of claim 7 wherein the steel cord filaments have a tensile strength at least defined by the equation of TS (MPa)=4800 MPa−(2000 MPa/mm)×D, where D is the filament diameter in mm.

* * * * *